US005722327A

United States Patent [19]

Hawthorne et al.

[11] Patent Number: 5,722,327

[45] Date of Patent: Mar. 3, 1998

[54] DEVICE FOR IMPROVING WARP STIFFNESS OF A RAILCAR TRUCK

[75] Inventors: V. Terrey Hawthorne, Lisle; Charles P. Spencer, Staunton, both of Ill.; Charles L. Van Auken, Dillsburg, Pa.; Terry L. Pitchford, St. Louis, Mo.

[73] Assignee: Amsted Industries Incorporated, Chicago, Ill.

[21] Appl. No.: 560,971

[22] Filed: Nov. 20, 1995

[51] Int. Cl.[6] ..... B61F 5/26

[52] U.S. Cl. ..... 105/218.1

[58] Field of Search ..... 105/218.1, 219, 105/220, 221.1

[56] References Cited

U.S. PATENT DOCUMENTS

| | | | |
|---|---|---|---|
| 1,414,554 | 5/1922 | Doerr . | |
| 2,207,848 | 7/1940 | Barrows | 105/224.1 |
| 4,674,412 | 6/1987 | Mulcahy et al. | 105/224.1 |
| 4,870,914 | 10/1989 | Radwill | 105/206.2 |
| 5,450,799 | 9/1995 | Goding | 105/222 |
| 5,509,358 | 4/1996 | Hawthorne et al. | 105/218.1 |
| 5,537,932 | 7/1996 | Jones | 105/218.1 |
| 5,572,931 | 11/1996 | Lazar et al. | 105/218.1 |

OTHER PUBLICATIONS

"Truck Hunting in the Three–Piece Freight Car Truck", by V.T. Hawthorne, P.E.

*Primary Examiner*—S. Joseph Morano
*Attorney, Agent, or Firm*—Edward J. Brosius; F. S. Gregorczyk; Stephen J. Manich

[57] ABSTRACT

A sideframe pedestal jaw accommodates a bearing adapter which locks the adapter to the sideframe, thereby preventing it from all forms of movement within the pedestal jaw opening. Locking the bearing adapter forces the truck axles to remain at a right angle with respect to the sideframes. Maintaining this right angular relationship substantially curtails truck warpage, which induces wheel misalignment that leads to undesirable truck hunting and high speed instability.

57 Claims, 7 Drawing Sheets

FIG. 8
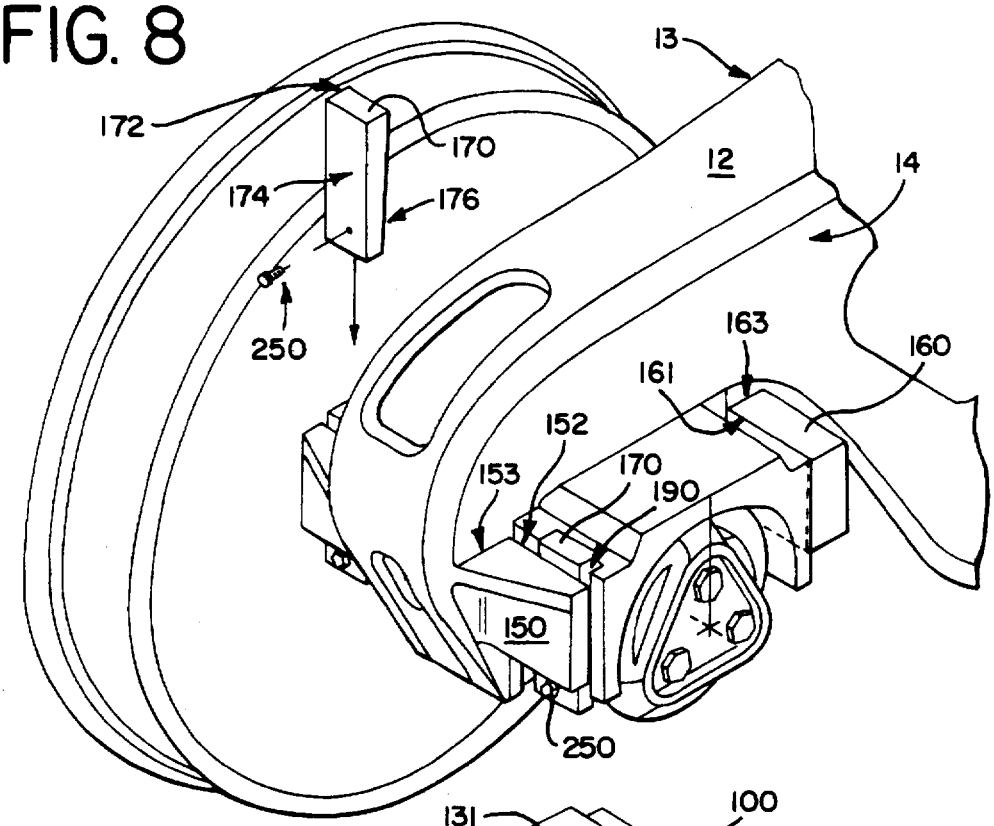
FIG. 8B
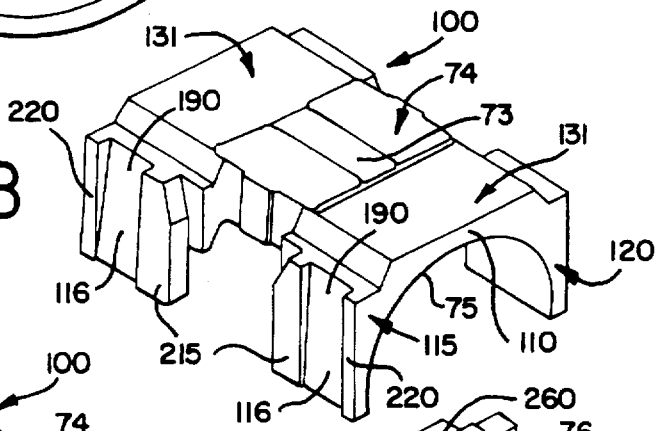
FIG. 8A
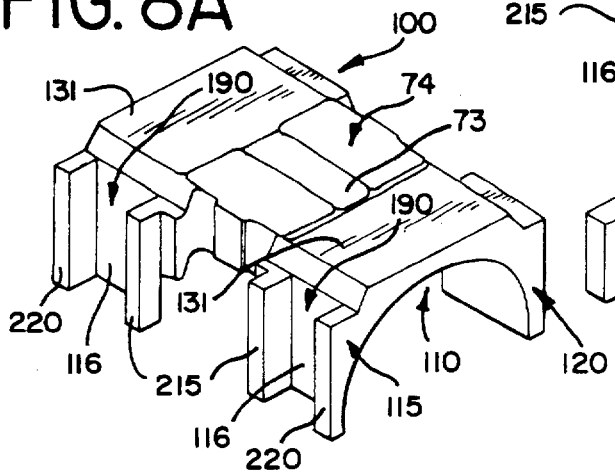
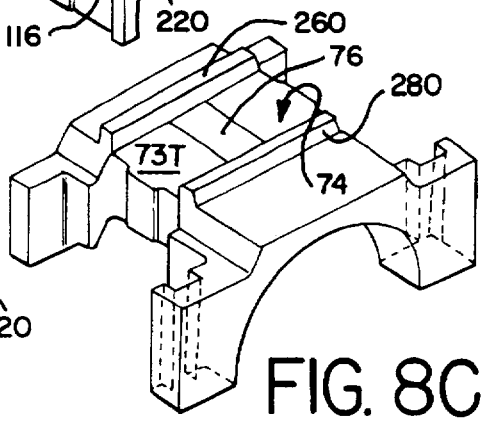
FIG. 8C

DEVICE FOR IMPROVING WARP STIFFNESS OF A RAILCAR TRUCK

FIELD OF THE INVENTION

The present invention relates to three-piece railroad car trucks and more particularly to a means for rigidly securing a truck pedestal jaw bearing adapter to the sideframe to prevent the bearing journal from angular displacement within the pedestal jaw, which consequently leads to angular axle displacement with respect to the sideframes and ultimately to resultant truck warping. Locking the bearing adapter within the pedestal jaw against angular or rotational displacement increases the truck warp stiffness while decreasing the propensity of the truck to hunt. Decreasing the propensity of a truck to hunt on the other hand, improves truck curving capabilities and high speed truck stability.

BACKGROUND OF THE INVENTION

In a conventional railway truck of the four-wheel type, the truck geometry is such that the axles are constrained by the sideframes and the bearing adapters so that they remain substantially parallel to each other under most operating conditions. Ideally, it is desirable that the truck maintain a ninety degree, or right angular relationship between the axled wheelsets and the sideframes during travel on straight and curved track, otherwise, an out-of-square condition known as warping will occur, which can ultimately contribute to truck instability. Warping has also been interchangeably referred to as parallelogramming or lozenging. Warping is the condition where the sideframes operationally remain parallel to each other, but one sideframe moves slightly ahead of the other in a cyclic fashion. Several of the more prominent factors contributing to warping are: dynamic instability or truck hunting above a threshold speed; track inputs which cause angular movement between the bearing assembly, the bearing adaptor, and the sideframe; or angular or rotational displacement of the bearing adapter and axle within the sideframe pedestal jaw. Warping also allows wheel misalignment with respect to the track, which can lead to the wheel moving laterally across the rails as the truck travels down the track. Warping is more pronounced on curved track and usually provides the opportunity for a large angle-of-attack to develop, which is also detrimental to overall truck curving.

Past research efforts have noted a significant relationship between truck warping and truck hunting. Therefore, it would be ideal if the truck axles could continuously align themselves with the radial axis of the tracks, as do the "steerable" type of trucks, where no angle-of-attack occurs. See FIG. 5A. However, the present invention is concerned with non-steerable trucks and, this steerable action does not occur since the tracks work against the wheeled axles, forcing them and the truck to assume an out-of-square or warped condition. An out-of-square truck travelling through curved track results with what is known in the art as a large angle of attack, defined herein as θ, the angle between the wheel flanges and the wheel rails. See FIG. 5B. A good compromise between a steerable truck and one which is easily warped is a truck like that of FIG. 5C, where the truck will remain substantially square or unwarped, resulting in a low angle of attack and a higher threshold speed at which truck hunting will occur.

Increasing the ability of a truck to resist warping is a very important operating variable in controlling truck instability. Truck hunting is a continuous wheel set instability where the truck weaves down the track in an oscillatory fashion, usually with the wheel moving laterally across the rail. Surprisingly, this means that even as a truck travels upon straight track, the wheels can be moving laterally across the tracks, causing a substantial amount of frictional wear occurring between the wheel and track. Thus, it should be realized that truck hunting not only wastes a great deal of locomotive horsepower and fuel in overcoming the frictional dragging forces, but these conditions can also cause car body and lading damage to vibration-sensitive ladings such as automobiles.

To improve truck warping in curving applications, prior art structures interposed elastomeric devices between the bearing adapter and the sideframe as a means for maintaining the wheelsets and sideframes in a generally right angular relationship with respect to each other while traveling on straight track. These devices were said to significantly reduce truck misalignment by providing a sufficiently resistive shear stiffness against lateral sideframe impacts, thereby assisting or maintaining the right angular relationship between the sideframes and wheelsets. The elastomeric devices were a means for damping the lateral impacts before they were transferred through the sideframe, bolster, and car body. The present invention completely suppresses the initiation of the impacts altogether. A sideframe structure incorporating a prior art elastomeric damping device is shown in U.S. Pat. No. 4,674,412, which is assigned to AMSTED Industries Incorporated of Chicago, Ill., the assignee of the present invention. Although this device helped prevent truck warping in curves, the truck warp stiffness overcome by the curving forces remained unchanged. Later devices concentrated upon physically restraining each sideframe from parallelogramming. One such device is shown in U.S. Pat. No. 4,870,914 to Radwill, also assigned to AMSTED Industries Incorporated. In that disclosure, a pair of cross-braced rods physically connected the sideframes together. Although parallelogramming was greatly reduced, movement of the bearing adapter within the pedestal jaw still allowed the truck to hunt on a limited basis, albeit at higher threshold speeds.

Addressing truck lozenging problems associated with newly assembled trucks is the subject of U.S. Pat. No. 5,450,799, and also commonly owned by the assignee of the present application, where inconsistent wheelbase dimensional tolerances between sideframes was found to contribute to a built-in truck lozenging. Positioning lugs were added to each of the pedestal jaw vertical walls, at the axle centerline. The lugs worked against the axles under certain out-of-square truck conditions, forcing the axle to remain in a generally "square" relationship with respect to the sideframes. However, the positioning lugs did not restrict the bearing adapter movement within the pedestal jaw, and this movement allowed the axle enough freedom to cause parallelogramming.

SUMMARY OF THE INVENTION

By the present invention, it is proposed to overcome the inadequacies encountered heretofore by using a means which locks the bearing adapter and bearing assembly within the sideframe pedestal jaw opening, thereby increasing the warp stiffness of the railcar truck by restraining the truck axles from permutating from their right angular relationship with the sideframes. To this end, the means for increasing the warp stiffness prevents the bearing adapter and hence, the bearing assembly, from rotational displacement within the pedestal jaw opening. Since the bearing assembly is secured against rotational displacement within the sideframe pedestal jaw opening, so is the axle. Fixing the axle effectively maintains the right angular relationship between the axles and the sideframes, while eliminating axle movements that normally lead to truck warping. To insure against rotational axle movement, the bearing adapter of the present invention is generally constructed with a pair of downwardly projecting chocks incorporated into each of the bearing adapter end faces. Each chock is constructed with a pair of legs which are extended beyond the horizontal centerline of the bearing assembly so that a significant portion of the bearing outer race is captured. These extensions lock the bearing adapter against rotational displacement within the jaw opening, even in extreme operating conditions. Prior art bearing adapters significantly differ from the adapter of the present invention in that they only capture a very small portion of the upper quadrants of the bearing assembly outer race. When certain extreme operating conditions such as curving are encountered, a prior art bearing adapter will not have the ability to continuously hold the bearing adapter against all forms of movement. During these types of conditions, the involved forces can work against the adapter in such a way as to cause the adapter to release its hold on the bearing assembly outer race by lifting on top of it. When such lifting occurs, the bearing assembly and axle have already assumed an out-of-square position with respect to the sideframes. It should be noted that this condition can occur even if the bearing adapter has been prevented from rotational displacement. The present invention on the otherhand, provides chock legs which extend below the horizontal centerline of the bearing assembly so that the bearing adapter never has the potential to lift. Since this phenomenon is the last remaining movement which can lead to rotational displacement of the bearing adapter within the pedestal jaw, the truck axles will always remain at a right angle with respect to each of the sideframes. It can therefore be appreciated that a truck incorporating a bearing adapter of the present invention will be more structurally resistant to parallelogramming and hunting. According to the present invention, it should also be clarified that in order to prevent angular bearing adapter displacement, the bearing adapter must be laterally or longitudinally restrained from movement within the pedestal jaw opening. This eliminates both directions of movement. Since the forces that are encountered in preventing an axle from displacing are so extreme, the bearing adapter of the present invention is physically larger than a typical prior art bearing adapter and the larger surface area better receives and distributes stresses.

A truck incorporating the present invention will remain fully capable of assuming positions reasonably coincident with the radii of curvature of curved railway track even though the axles are prevented from yaw displacement relative to the sideframes. This is possible because of the ability of the truck to swivel or rotate about the centerplate. For example, when the axle is prevented from yawing relative to the sideframes during the initiation of cornering, the truck can still corner because the axles will transmit the yawing forces into the whole truck via the sideframes, causing the truck to rotate or yaw about its own center.

BRIEF DESCRIPTION OF THE DRAWINGS

FIG. 8 is a partial perspective view showing a second embodiment of the present invention wherein the adapter is prevented from longitudinally moving;

FIG. 8A is a perspective view of the unitary bearing adapter of the present invention;

FIG. 8B is a perspective view of a second, unitary bearing adapter of the present invention;

FIG. 8C is a perspective view of a bending adapter which incorporates thrust lugs.

DESCRIPTION OF THE PREFERRED EMBODIMENT

Figure 1:
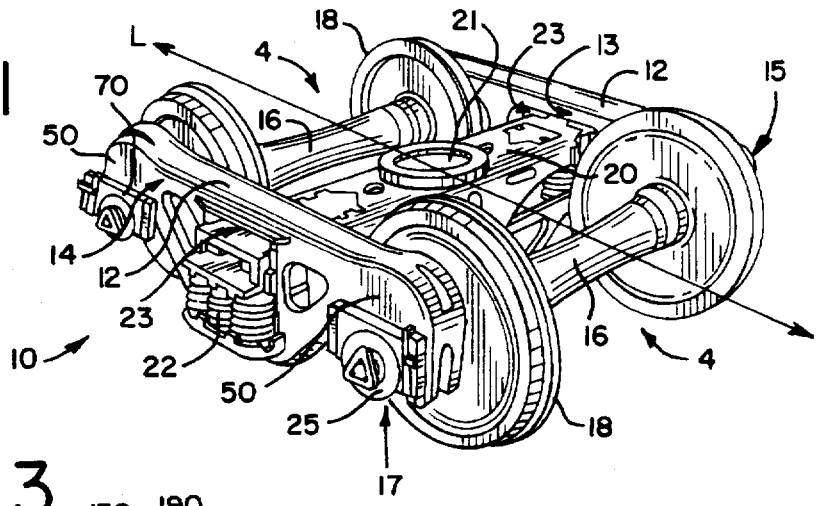
FIG. 1 is a perspective view of a railway truck incorporating an embodiment of the bearing adapter of the present invention.
Figure 2:
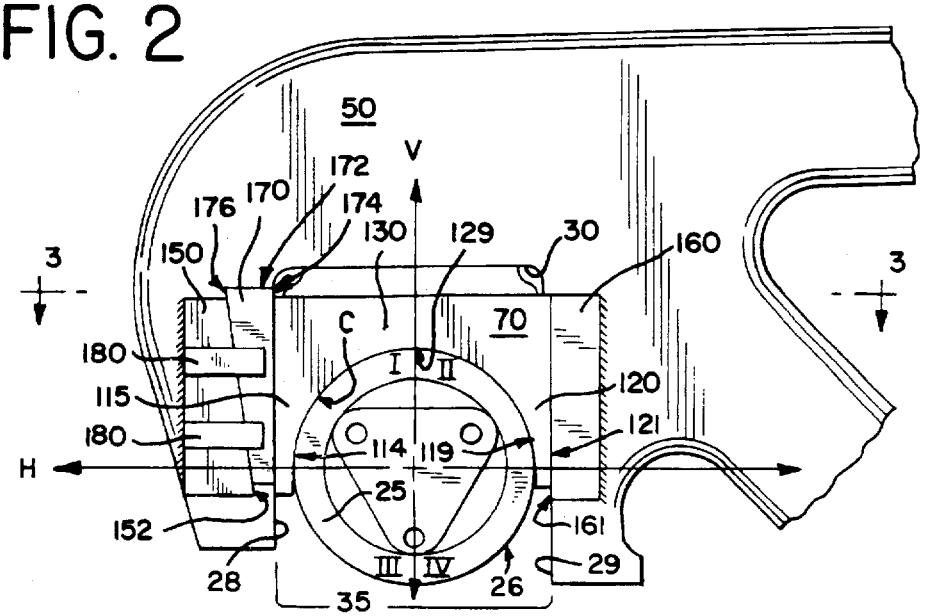
FIG. 2 is a partial sectional view of a sideframe end illustrating the position of the present invention within the pedestal jaw.
Figure 4:
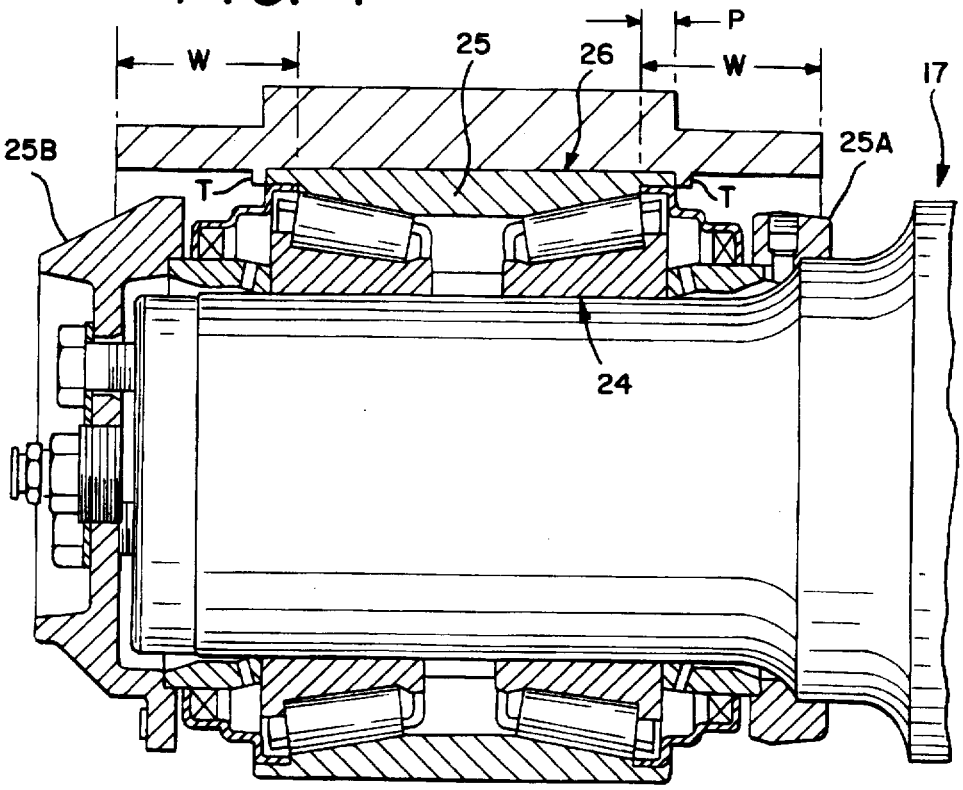
FIG. 4 is a side cross sectional view of the bearing adapter of the present invention.

Referring now to FIG. 1, there is shown a railway vehicle truck 10 incorporating the present invention. The truck 10 generally comprises laterally spaced first and second sideframes 12 disposed in a generally parallel relationship to truck longitudinal axis L. Each sideframe has a respective inboard face 13 and an outboard face 14, and the sideframe pairs are mounted on a pair of spaced wheelsets 4. Each wheelset 4 is comprised of an axle 16, mounted wheels 18, and bearing assemblies 25. The bearing assemblies are mounted on the first and second axle ends 15,17 of each axle 16. FIG. 4 shows in greater detail that each bearing assembly is held onto axle end 17 by a backing ring 25A and by the axle end cap 25B. Bearing 25 has a roller type bearing with outer race 26 and inner race 24. The inner race 24 is pressed onto axle end 17, and thus rotates with axle end 17, as do backing ring 25A and axle end cap 25B. Outer race 26 remains stationery with respect to axle end 17. Mounted between the sideframe and bearing assembly 25, is the bearing adapter 70 of the present invention as shown in FIG. 2. Each sideframe 12 includes a pedestal jaw 50 at each end and a bolster opening 23 at the sideframe midsection. Bolster 20 extends between each of the sideframe bolster openings 23 and is resiliently supported by springs 22. Bolster 20 is connected to a railcar underside at centrally-located center plate 21.

FIG. 2 illustrates in greater detail that each sideframe end has a pedestal jaw 50 formed by a vertical forward wall 28 and a vertical rearward wall 29 interconnected to a pedestal jaw roof 30. Pedestal jaw roof 30 is horizontally disposed substantially parallel to truck longitudinal axis L and perpendicular to each wall 28, 29. Vertical walls 28, 29 and pedestal roof 30 of each pedestal jaw 50 define a respective pedestal jaw opening 35 for receiving the wheeled axles 16 (FIG. 1), such that axles 16 are generally disposed at a right angle to each sideframe 12 and to axis L.

Each pedestal jaw opening 35 has a lateral extent which corresponds to the width between the sideframe faces 13 and 14, at the jaw area and a longitudinal extent which corresponds to the span or distance between said forward and rearward walls 28,29. Each pedestal jaw opening receives a bearing adapter 70 of the present invention, which is in continuous contact with roof 30 and is generally held in a centered positioned within opening 35 by the opposed thrust lugs 36,38 (See FIG. 3). Each thrust lug is integrally formed on the upper portion of vertical walls 28,29, and they are primarily provided to restrict the lateral movement of the bearing adapter. Each thrust lug also performs a secondary role of limiting the extent of longitudinal bearing adapter movement.

Figure 3:
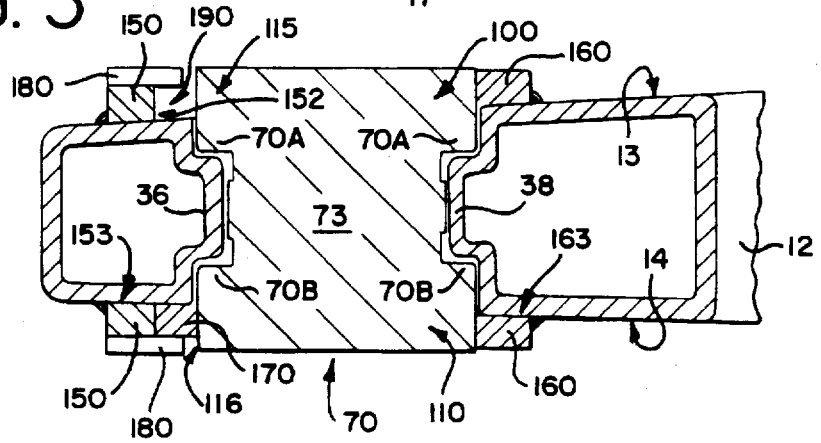
FIG. 3 is a top sectional view of the present invention shown in FIG. 2.

Bearing adapter 70 generally functions to hold axle 16 and transfer bearing forces into the pedestal jaw area. As the top view of FIG. 3 illustrates, bearing adapter 70 of the present invention extends beyond the lateral extent or width of each respective pedestal jaw opening, thereby protruding outwardly beyond sideframe faces 13 and 14 by an equal extent. When comparing bearing adapter 70 of the present invention to the prior art adapter shown in FIGS. 7 and 7A, it can be appreciated that this protrusion is rather substantial and it performs two very important functions in relation to keeping the truck "square", both functions being explained immediately below. Moreover, the side view of FIG. 2 also shows that the bearing adapter of the present invention captures a substantial circumferential portion of axle bearing outer race 26. This point is clearly understood by comparing the portion of the outer race captured by the present invention, to the portion of the outer race captured by a prior art bearing adapter 70', as best seen in FIG. 7A.

When comparing FIG. 2 to FIG. 7A, it is seen that the bearing adapter of the present invention is physically much larger and it extends downwardly beyond the bearing assembly vertical midpoint, designated as the horizontal axis H. The axis H and the vertical axis V, which axis V intersects axis H at the bearing assembly horizontal midpoint, collectively form four quadrants, which bearing assembly 25 is centered about. For the sake of this discussion, the outer race 26 can be divided into the upper quadrants, represented by the Roman numerals I and II, and the lower quadrants, represented by the numerals III and IV. The same nomenclature is used in describing the outer race 26' in relation to the prior art adapter shown in FIG. 7A, since the bearing assembly shown there would be identical to the one of the present discussion.

Figure 7:
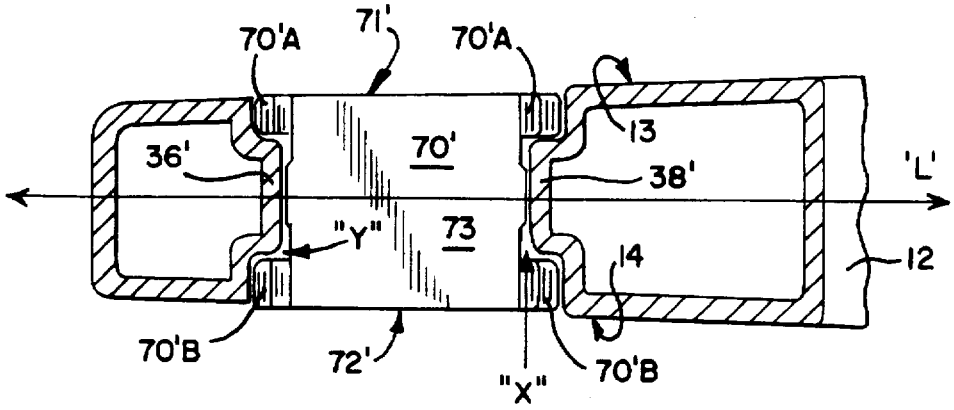
FIG. 7 PRIOR ART
FIG. 7 is a top view of a prior art bearing adapter within a pedestal jaw.
Figure 7A:
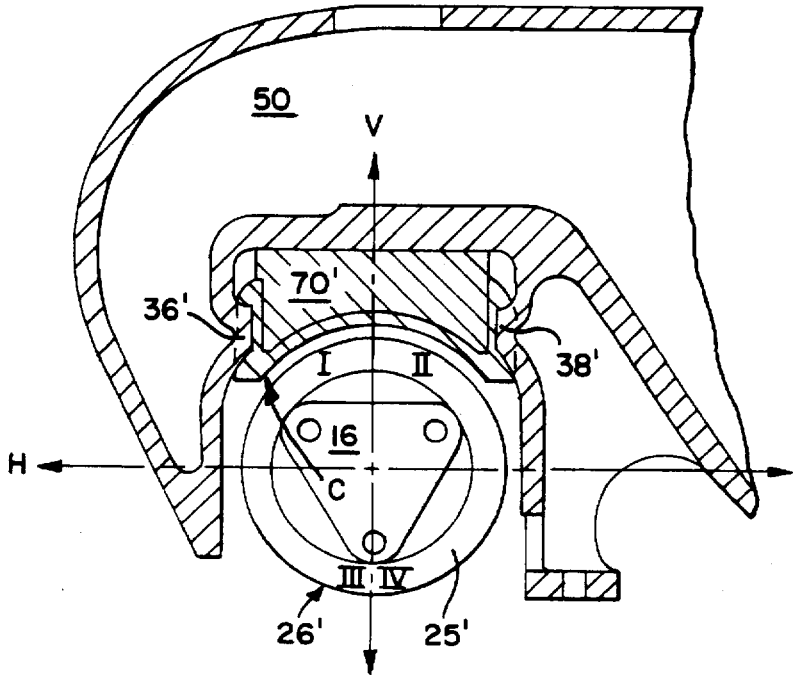
FIG. 7A PRIOR ART
FIG. 7A is a fragmentary view of a sideframe pedestal jaw showing a prior art bearing adapter.

It is seen from FIG. 7A that a prior art bearing adapter 70' only encapsulates the bearing race 26' in the very top portions of upper quadrants I and II. On the other hand, FIG. 2 shows that the bearing adapter 70 of the present invention encapsulates a far greater portion of the outer race 26 by totally surrounding upper quadrants I and II, while a portion of the adapter even extends into lower quadrants III and IV. Capturing a very large circumferential portion of the bearing assembly is a key to the present bearing adapter performing the desired truck squaring functions, as will be realized from the remaining description. As mentioned, the physical dimensions (i.e., length, outside diameter) of axle bearing assembly 25 are quite similar, regardless of whether a prior art bearing adapter or the present adapter is being described.

Directing attention to FIGS. 7 and 7A, further differences between the present bearing adapter and a prior art adapter will be highlighted. In the prior art adapter, the pair of horizontally opposed pedestal thrust lugs 36',38' were used for laterally and longitudinally maintaining the prior art bearing adapter 70' in a generally centered position within the pedestal jaw opening by typically providing clearances "X" and "Y" between the thrust lugs and the bearing adapter. These clearances were tightly controlled and they gave the bearing adapter, the bearing assembly, and the axle end a limited degree of lateral freedom (movement normal to longitudinal direction L), as well as longitudinal freedom. Normal operational wear or slack increased the total freedom over time, and eventually, the prior art adapter had enough lateral and longitudinal freedom to rotationally displace within the pedestal jaw opening. Rotational displacement led to increased axle yawing (cocking or twisting) with respect to the sideframes, and as, previously stated, truck axle displacement leads to very poor truck squaring capabilities. It was discovered that if at least one of these degrees of freedom (lateral or longitudinal) was eliminated, the truck would become resistant to out-of-squareness and hunting. It was also discovered that simultaneously eliminating the lateral and longitudinal directions of freedom has no improved effect on truck squaring capabilities.

With the bearing adapter of the present invention, providing thrust lugs is a matter of what direction the bearing adapter is prevented from displacing. For example, if longitudinal adapter movement is to be eliminated, then thrust lugs can be provided on the pedestal jaw walls, or they can be removed from the walls and then incorporated into the design of the bearing adapter itself. An adapter incorporating the thrust lugs would look similar to the embodiment shown in FIG. 8C, where the upstanding ledges 260,280 perform the same function as typical thrust lugs by limiting lateral adapter movement between the faces 13,14 of sideframe 12. Ledges 260,280 are preferably cast as part of the bearing adapter top surface and when the adapter is inserted into the pedestal jaw opening, it should be understood that each of the flanges will engage sideframe faces 13,14, effectively interposing the adapter therebetween. It can be appreciated that the desired lateral freedom will be dependent upon the tolerances provided between the upstanding ledges and the sideframe faces.

Figure 9:
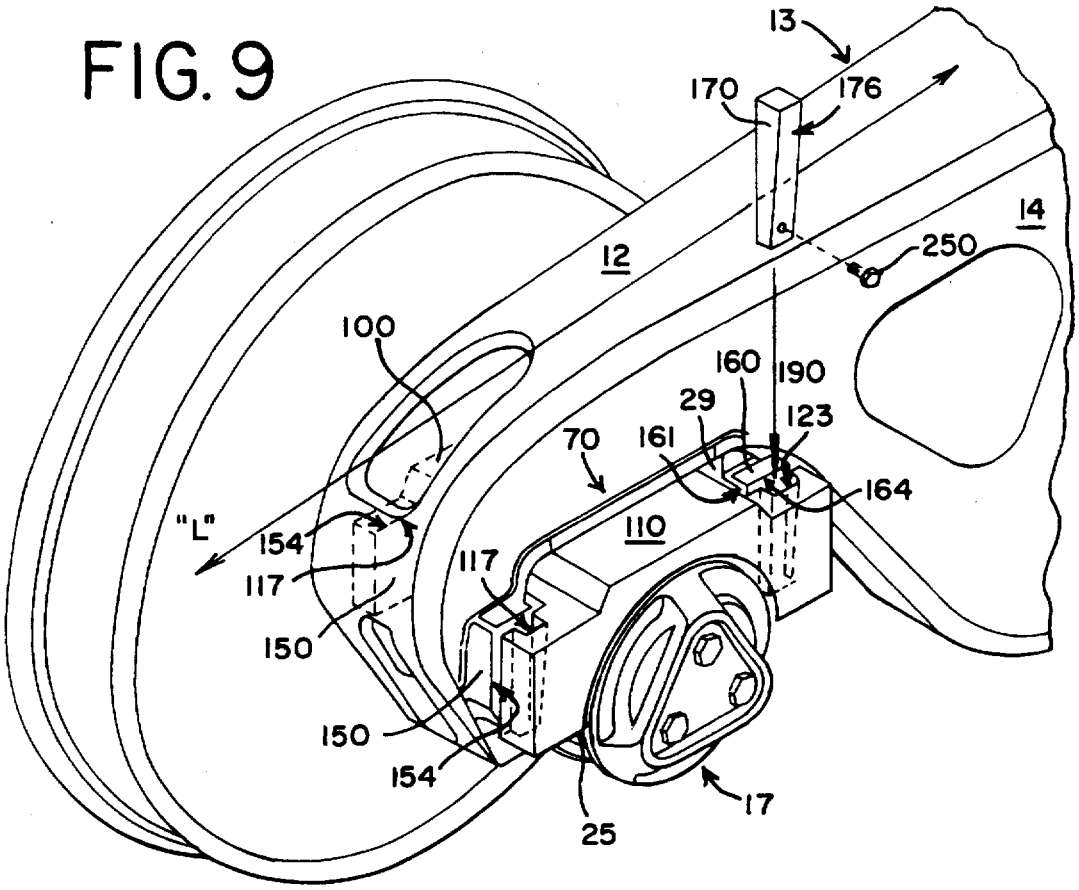
FIG. 9 is a perspective view of another embodiment of the present invention wherein the bearing adapter is prevented from laterally moving.
Figure 9A:
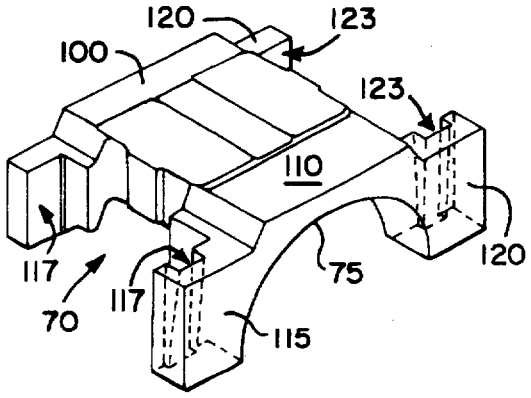
FIG. 9A is a perspective view of a laterally restrained, unitary bearing adapter.
Figure 9B:
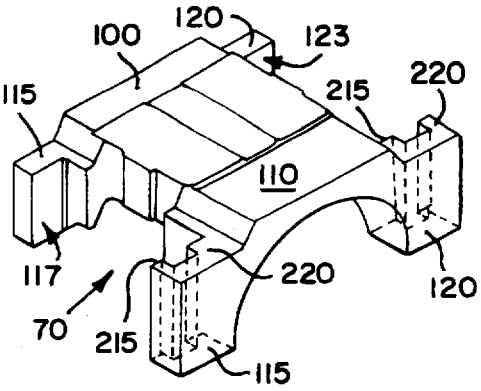
FIG. 9B is a perspective view of a second embodiment of a laterally restrained, unitary bearing adapter.
Figure 10:
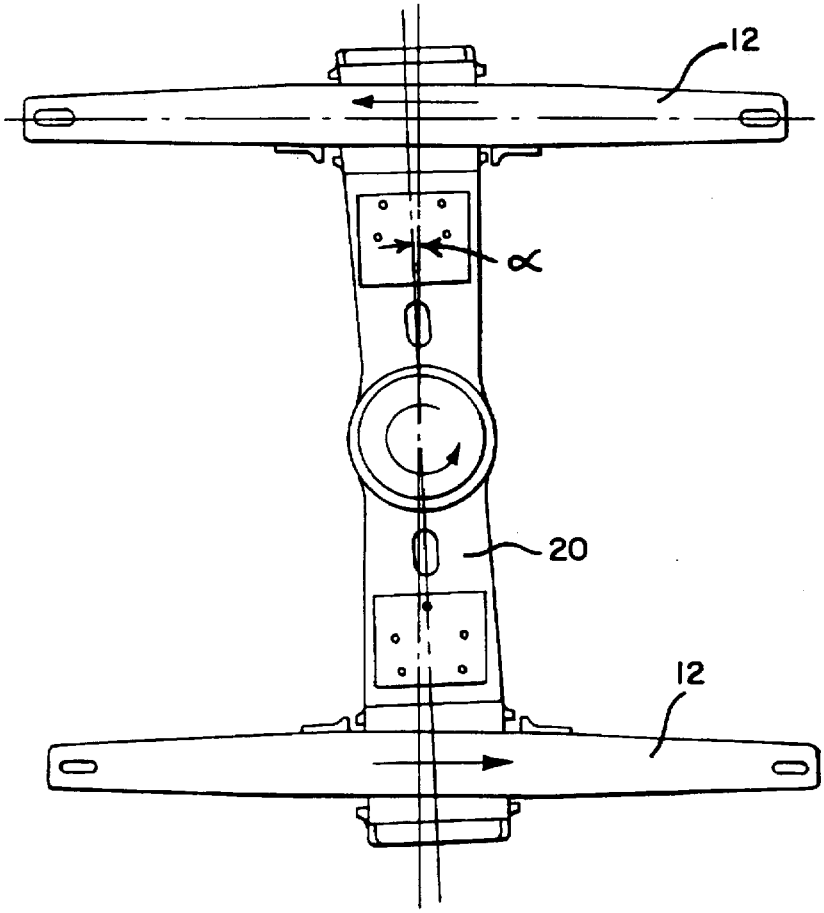
FIG. 10 PRIOR ART
FIG. 10 is a top view of an out-of-square or parallelogrammed truck, where one sideframe is ahead of the other.

The bearing adapter embodiments shown in FIGS. 9, 9A, and 9B are designed to eliminate lateral bearing adapter movements, and as will become evident during the discussion of those adapters, those adapters do not provide thrust lugs on the pedestal jaw walls, or on the adapter. FIG. 9 illustrates a wedging means to eliminate the adapter lateral movement, and after the detailed description is reviewed, it will become clear why thrust lugs are not needed. With the lateral elimination designs, the adapters can be sized such that the pedestal jaw walls act as thrust lugs for limiting longitudinal movements, therefore, lugs to limit longitudinal movement are not needed.

As mentioned above, eliminating either the lateral or longitudinal freedom of the bearing adapter will eliminate the rotational movements which lead to truck warping. In one form of the invention shown in FIG. 6, a means for locking bearing adapter 70 against rotational displacement within the pedestal jaw opening is provided wherein the longitudinal movement of the adapter is eliminated. This is accomplished by providing the inboard and outboard sides 71,72 of each bearing adapter body 73 with lateral extensions, referred herein as chocks 100,110, for tightly holding the outer race of the roller bearing, and preventing the longitudinal displacement of each of the chocks. It is noteworthy to mention that for all described embodiments, the bearing adapter body 73 will be quite similar in physical size and shape to what was considered a prior art bearing adapter. Referring to FIGS. 2 and 3, preventing longitudinal displacement of each of the chocks is accomplished by interposing each of the bearing adapter chocks between a front stop 150 and a back stop 160 on each sideframe face 13,14. Each means (stop) for preventing longitudinal displacement, tightly locks the entire bearing adapter 70 (body 73 and chocks 100,110) in the longitudinal direction within the pedestal jaw opening 35 such that rotational bearing adapter displacement is all but eliminated. To ensure that operational component wear will not compromise the performance of the means for preventing longitudinal displacement, an additional means for maintaining continuous, rigid contact between the chocks and the stops is incorporated therebetween. The three elements comprising the present invention, the bearing adapter chocks, the means for preventing displacement of the bearing adapter, and the means for maintaining continuous rigid contact will now be explained in greater detail.

Figure 6:
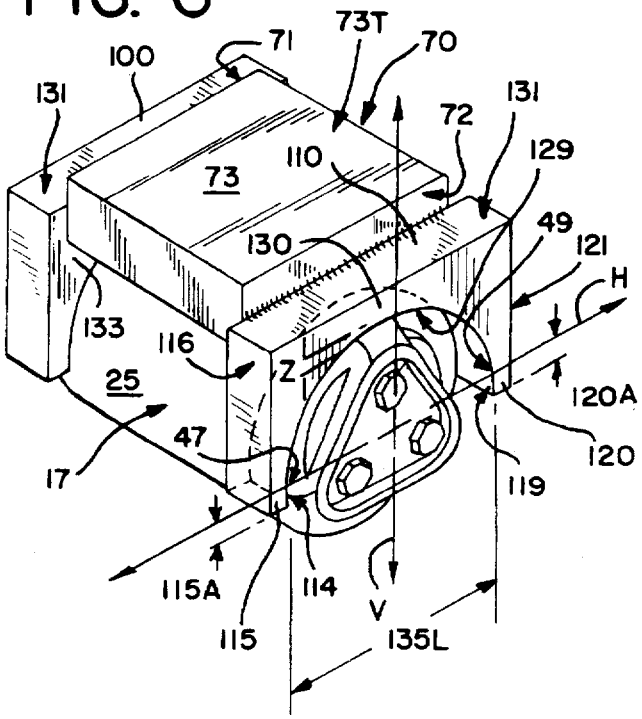
FIG. 6 is a perspective view of a fabricated bearing adapter of the present invention.

For the sake of clearly defining the present invention, the portions of the present invention which comprise the inboard and outboard chocks 100,110 will be shown and described in FIG. 6 as discrete elements attached to (usually by welding along joined edges) the bearing adapter body 73, although it should be emphasized that it is preferable to cast the chock elements 100,110 and the bearing adapter body 73 as a unitary and integral cast steel bearing adapter, as shown in the FIG. 8 embodiments. The bearing adapter embodiments which will follow, will also have chocks 100,110 being used in conjunction with stops (means for preventing displacement) and wedges 170 (means for maintaining continuous rigid contact) to operatively lock each bearing adapter 70, bearing assembly 25 and axle 16 within the pedestal jaw opening 35 so that neither axle end 15,17 can displace in the longitudinal direction. FIGS. 3, 8A and 8B generally show a unitary bearing adapter of the present invention wherein the chock portions are integrally formed with the bearing adapter body 73.

Since each inboard and outboard chock portion 100,110 is a mirror image in dimensional size and extent, and since all bearing adapters utilized on the truck are also mirror images to each other, only one bearing adapter, and hence only one set of chocks will be described in greater detail. Further, the description of the outboard chock will equally apply to the inboard chock. As mentioned earlier, each chock generally performs the squaring function of the truck by preventing rotational displacement of the bearing adapter, thereby simultaneously maintaining each of the axles in the desired right angular relationship with respect to both of the sideframes. To guarantee proper truck squareness after initial assembly, each sideframe of the truck must have the exact longitudinal chock-to-chock dimensions as its partner sideframe, otherwise, one or both axles could conceivably be held in a slightly cocked or angled position relative to each of the sideframes comprising the truck. If this were the case, the axle(s) which was not maintaining the right angular relationship would cause the truck to drag, even when operating on straight track.

Figure 6A:
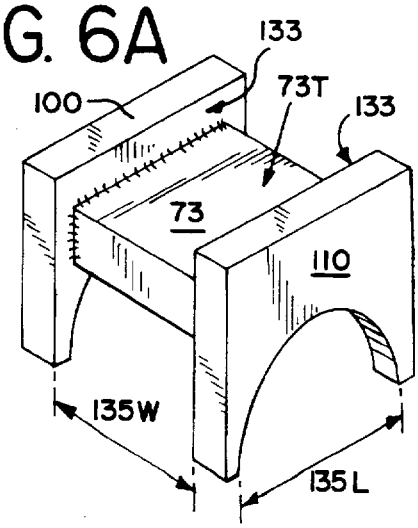
FIG. 6A is a perspective view of the bearing adapter of FIG. 6, wherein the chocks are extending above the roof.
Figures 5A, 5B, 5C:
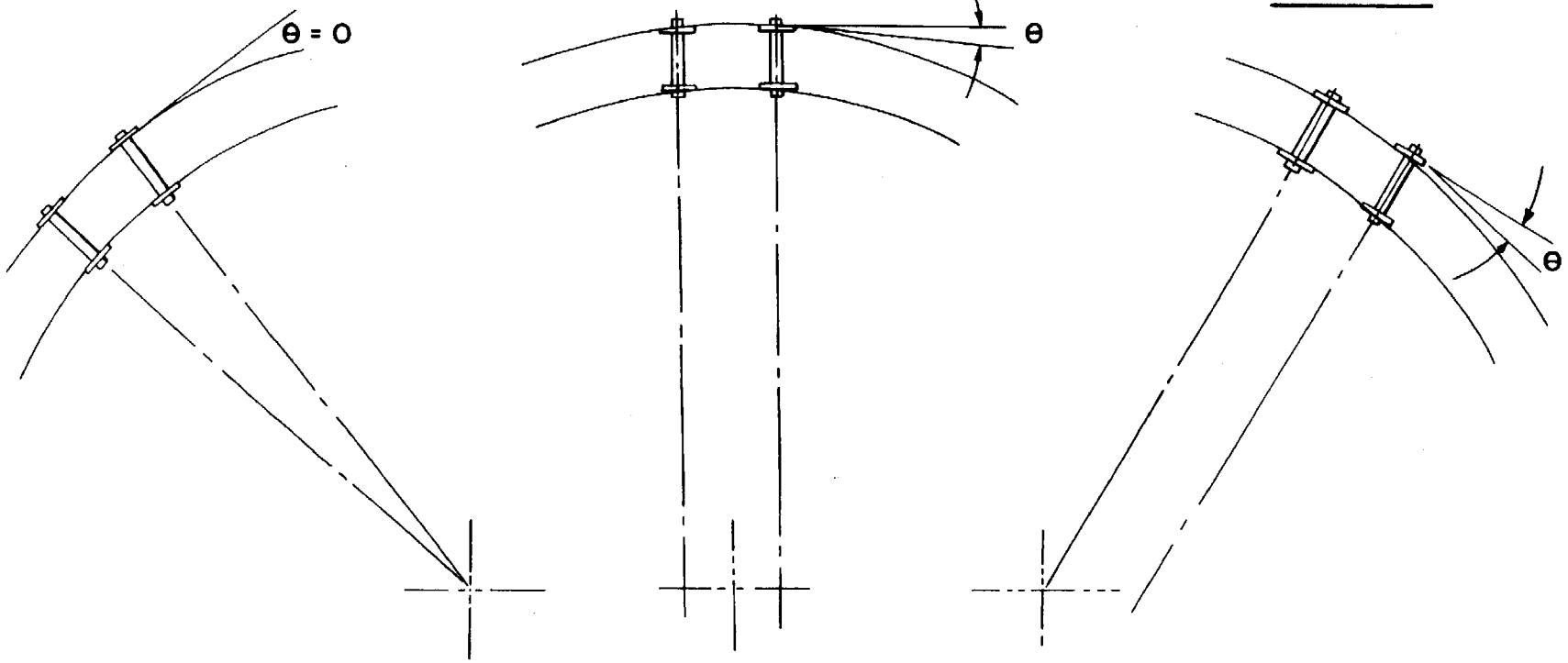
FIG. 5A PRIOR ART
FIG. 5B PRIOR ART
FIG. 5A is diagrammatic view of a steerable truck on curved track emphasizing a zero angle of attack between the wheel flanges and the rails.
FIG. 5B is diagrammatic view of an out-of-square truck on curved track with a large angle of attack.
FIG. 5C is a diagrammatic view of a squared truck exhibiting a small angle of attack even without the truck exhibiting steerable capabilities.

Turning attention to FIGS. 2 and 6, the general features of a fabricated bearing adapter of the present invention will be described in greater detail, although the descriptions will equally apply to the cast, unitary versions shown in FIGS. 8 and 9. It is seen in FIGS. 2, 9A and 9B that outboard chock 110 of bearing adapter 70 is a solid member having a front leg 115 with an arcuate inside surface 114, a back leg 120 with an arcuate inside surface 119, and a roof portion 130 also having an arcuate inside surface 129. These arcuate inside surfaces on each respective chock 100,110, along with the arcuate bottom surface 75 of adapter body 73, are collectively coextensive such that they define a cavity 135 within the bearing adapter 70 for receiving bearing assembly 25. FIG. 6A shows that cavity 135 has a longitudinal extent 135L, and a lateral extent or width 135W. FIG. 6 shows cylindrical bearing assembly 25, and the axle end 17 inserted therein. Cavity 135 can be considered as having a generally semi-cylindrical shape which laterally extends across the entire bearing adapter 70, since the open, lower portions of each inboard and outboard chock 100,110, are generally U-shaped, and form the lower boundaries of the cavity.

All bearing adapter embodiments of the present invention will be comprised of three main components, the body, the inboard chock, and the outboard chock. The inboard and outboard chocks, as a pair, will have slightly different constructions, depending upon whether the bearing adapter is prevented from displacement in the longitudinal or lateral direction. All bearing adapters which are prevented from longitudinal displacement will have front and back chock legs 115,120 on each inboard and outboard chock that are generally vertically planar, with outside surfaces 116 and 121. The roof portion 130 on each chock will have a horizontally disposed planar top surface 131, which is preferably coextensive with top surface 74 of adapter body 73. In the unitary bearing adapter embodiments shown in FIGS. 8–8B, and 9–9B, it is seen that top surface 131 of each respective chock roof is integrally formed with top surface 73T of each adapter body 70, thereby forming a unitary, coextensive bearing adapter top surface 74. In addition, the embodiments of FIGS. 8A–8B show that with the longitudinally-restricted bearing adapters, a crown can optionally be provided in a lateral direction across bearing adapter top surface 74 such that each face includes a slight depression area 76. This crowning provides each of the sideframes with the capacity to slightly rock in a direction about the longitudinal centerline of the sideframe, and this helps the truck isolate some of the lateral impacts directed at the truck. The bearing adapters, which are prevented from lateral displacement, would usually not incorporate a crowned top surface since the means for preventing displacement eliminates all laterally directed movements.

Regardless of whether the bearing adapter eliminates lateral or longitudinal movement, once the adapter is installed within the pedestal jaw opening 35, top surface 73T of body 73 will be contacting pedestal jaw roof 30, while top surfaces 131 on each of chocks 100,110 will be arranged such that they are physically outside of pedestal jaw opening 35, and disposed so that they are substantially parallel with and on the same horizontal plane as pedestal jaw roof 30. These relationships are slightly different when the bearing adapter of the present invention is fabricated, instead of cast as a unitary member. The fabricated version of the present invention is shown in FIGS. 2 and 6, and is of the type which is prevented from longitudinal displacement. On each of chocks 100,110, a roof top surface 131 is displaced lower than adapter body top surface 73T, although it can be fabricated such that the roof surfaces are coextensive with body surface 73T, or they can be displaced above surface 73T. When the illustrated version is installed within pedestal jaw opening 35, top surface 73T of body 73 is in contact with pedestal jaw roof 30, while top surfaces 131 of each of chocks 100,110 will be located outside of pedestal jaw opening 35 and disposed such that they are substantially parallel with pedestal roof 30, although they will not be lying on the same horizontal plane as pedestal roof 30. If the bearing adapter is fabricated with each of the chock roof surfaces disposed below adapter body top surface 73T, then outboard side surfaces 71,72 of body 73 will accept a line of weldment material, as best seen in FIG. 6, for securing the chocks to the body. If the bearing adapter is fabricated like the one shown in FIG. 6A, wherein the chocks are attached to the body so that top surfaces 131 are disposed above adapter body top surface 73T, then a line of weldment material would be applied along the intersection of top surface 73T and chock side surfaces 133. The fabricated bearing adapter illustrated in FIG. 6A will be specifically used only when the pedestal jaw has been cast without thrust lugs. As mentioned earlier, if the bearing adapter of the present invention is of the type where longitudinal displacement is being eliminated, then lateral bearing adapter displacements must still be limited through some type of means, either on the pedestal jaw or on the adapter itself, or the sideframe can eventually work itself off the adapter top. The bearing adapter of FIG. 6A uses the upstanding roof portions 130 of each of chocks 100,110 as the means for limiting lateral movement of the adapter within the pedestal jaw opening. It can be appreciated that when the adapter is inserted into the pedestal jaw, sideframe inboard and outboard faces 13,14 will be in contact with side surfaces 133 of each respective chock, thereby limiting lateral bearing adapter movements.

Bearing adapter cavity 135 mentioned earlier was said to have a generally semi-cylindrical configuration, and it is preferable to size cavity 135 such that bearing assembly outer race 26 will be securely mated therein. As best shown in FIGS. 2 and 6, all adapters are provided with respective inside surfaces 114 and 119 on legs 115 and 120, tangential to outer race 26 at opposite points 47 and 49 along bearing horizontal axis H. Since bearing assembly 25 has a cylindrical body which is comprised of the bearing assembly outer race 26, the race will define a bearing assembly outside diameter. This diameter will dictate the size of cavity 135. Thus it can be appreciated that cavity 135 will define a second diameter which is of an extent that is about 0.05 inch larger (maximum) than the outer race diameter of bearing assembly 25, or roughly the distance between inside chock leg surfaces 114,119, at tangential points 47,49 along horizontal axis H.

As mentioned earlier, one of the main objectives of the present invention is to extend each of chock legs 115,120 downwardly to an area at least around tangential points 47,49, so that a very large portion of outer race 26 of bearing assembly 25 is encapsulated by each bearing adapter. It was discovered that it is preferable to provide each chock leg with an extension 115A,120A, that projects beyond tangential points 47,49 so that the adapter is completely locked within the pedestal jaw opening, thereby ensuring that the bearing assembly and axles will be prevented from yaw or rotational movements. Each leg extension 115A,120A should preferably project beyond tangential points 47,49, by an equal extent of about one sixteenth of the bearing assembly outside diameter, or about one-sixteenth of the extent between tangential points 47 and 49. If the legs are only extended to a point slightly above tangential points 47,49, bearing adapter 70 will still have the inherent capability to lift on top of bearing assembly outer race 26 during some of the more extreme operating conditions. From previous descriptions, it should be clear that if the bearing adapter lifts on top of the bearing assembly, the axle has already displaced or yawed within the pedestal jaw opening, and the truck is highly warped.

An understanding of how the chock leg extensions prevent the bearing adapter from lifting can best be understood through an explanation of this phenomenon as it occurs with the prior art adapter of FIG. 7A. In that illustration, it is seen that the bearing adapter only extends downwardly along outer race 26' to contact point C. This contact point is also shown on the present bearing adapter of FIG. 2 to emphasize the role chock legs 115,120 and their extensions have in preventing this phenomenon. Any out-of squaring truck condition, such as curving, typically causes bearing assembly 25' to longitudinally act against a prior art adapter at contact point C. If the forces working to displace the axles are very severe, as during curving, a prior art bearing adapter 70' will not hold and contain bearing assembly 25' or axle in the desired right angular relationship with the sideframes since the adapter only captures a small portion of the very upper quadrants of the bearing assembly outer race. Therefore, it should be understood that there is no structural component on the prior art adapter to prevent bearing assembly 25' and the axle end from rotating under and resultantly assuming a position underneath contact point C. The axle will temporarily remain in that position with adapter contact point C on top of outer race 26' until the axle and bearing assembly return to their normal operating position, as when straight track is again encountered. When the truck again encounters straight track, the prior art adapter again rotates down across outer race 26', and re-engages the upper quadrants of the bearing assembly.

With the present invention, the potential lifting condition will only exist if the legs of each bearing adapter chock do not downwardly extend past bearing assembly horizontal axis H and tangential points 47,49. This means that under severe conditions, lifting can still occur on a bearing adapter of the present design as long as legs 115 and 120 only extend close to or even with tangential points 47 and 49. In practice, it has been found that the longer the extensions reach past axis H, the less likely for any chance of the adapter to rotate and therefore lift. However, there is a small tradeoff in making the extensions too long, in that installation of the bearing adapter becomes more difficult. That is why extensions 115A and 120A should preferably be about one sixteenth of the diameter of the axle bearing outside diameter. In addition, it is preferred that chock leg extensions 115A, 120A be constructed so that they extend straight down beyond points 47,49, instead of following the curvature of the outer race so that installation of the adapter over the bearing race is further facilitated. Furthermore, it is preferable to keep inside surfaces 114,119,129 of each chock as closely mated to race 26 as possible, and it was found that a tolerance of 0.005 inch allowed the adapter to fit tightly, yet be removed without difficulty. It is noteworthy to mention that this same tolerance is to be maintained at tangential contact points 47,49, and then once leg extensions 115A, 120A, are encountered, it should be clear that this separation tolerance may become slightly larger since the extensions will no longer be following the curvature of race 26. It was determined that this additional separation gap on the leg extensions had no effect or influence in creating longitudinal axle displacement.

It is also noteworthy to discuss the separation distance Z which FIG. 6 illustrates as existing between bearing assembly outer race 26 and bottom arcuate surfaces 114,119, and 129 of each chock. Examination of FIG. 4 reveals that there is no actual separation distance Z between outer race 26 and chock inside surfaces 129, 114 and 119 on each of the legs of the chocks. However, since this figure is a cross sectional view taken axially along the bearing adapter shown in FIG. 6, it is seen that each chock 100,110 has a total width or extent indicated at W, wherein only a portion of that width, P, actually encapsulates the perimeter of bearing assembly outer race 26, as described above, and there is no intended separation existing between surface P and race 26.

As surface P is rather insubstantial, it was found that a chock having a width equivalent to the portion P could prevent the axle end from displacing. However, during testing, it was found that a chock of this width had an accelerated wear life. It was realized that when each chock was provided with a width W instead of a width P, the bearing adapter wear life at the chocks, could be increased substantially, usually that it could be extended to require replacement with regular scheduled maintenance for the truck. But more importantly, the increased chock with also provided the necessary surface area for incorporating the means for preventing the displacement of the bearing assembly, which will be explained below.

In order to sufficiently increase the bearing adapter wear life so that it corresponds with scheduled truck maintenance, it was found that the chock width W should be at least four times the width of portion P. Since the chock width requirements meant that each chock was extended beyond the roller bearing itself, provision had to be incorporated into each chock 100,110 so that axle end cap 25B, and backing ring 25A, would remain free to operate rotationally with axle end 17. It is further seen in FIG. 4 that neither cap 25B, nor backing ring 25A, have cross sectional diameters larger than the cross sectional diameter of roller bearing outer race 26. Therefore, when chock inside surfaces 114, 119, and 129 are machined to mate with outer race 26, it is seen that entire chock width W, except for thrust flange T, is cut away such that tolerances are automatically provided to ensure clearance for rotationally operating elements 25A and 25B. Inboard and outboard thrust flanges T also seen in FIG. 4, have no role in preventing the bearing assembly from longitudinally displacing, rather, they are machined into the adapter body for the purpose of laterally holding the bearing adapter onto the bearing assembly. Otherwise without them, there is nothing holding the bearing adapter and the bearing assembly in their mated relationship, for the thrust lugs on the pedestal jaw walls function to laterally retain the adapter, while the end cap and backing ring laterally retain the bearing.

Turning attention now to FIGS. 2, 3, and 8, a means for preventing longitudinal displacement of the bearing adapter will now be described in greater detail, and it will be seen that this means principally operates against the chocks of the bearing adapter. A separate detailed description of the means for preventing lateral bearing adapter displacement will follow since the lateral prevention means has a few subtle structural and operational differences when compared to the longitudinal means. The purpose of the displacement prevention means is to effectively lock the entire bearing adapter against longitudinal displacement or movement within the pedestal jaw opening, which in turn will prevent the rotational bearing adapter displacements which lead to truck warpage. If such means were not provided, and the bearing adapter was initially sized and installed such that it had little or no movement within the pedestal jaw opening, the operating stresses on the adapter would soon create enough operational slack that the adapter would be capable of rotationally displacing within the pedestal jaw opening. However, as will be appreciated later in this discussion, in addition to the means for preventing longitudinal movements, a simple means will also be provided for ensuring continuous rigid contact between the bearing adapter and the means for preventing its longitudinal displacement. This second means will continuously remove the slack in the system which is created from wearing.

In accordance with the objective of eliminating rotational bearing adapter displacement, a means for preventing longitudinal bearing adapter movement in the form of a respective pair of front and back sideframe stops 150,160, is provided on each sideframe face 13,14. Collectively, stops 150,160 prevent longitudinal axle movement within pedestal jaw opening 35, even when out-of-squaring conditions are encountered. As best seen from FIG. 3, there is one set of front and back stops on each inboard and outboard face 13,14 of each sideframe 12, and at each pedestal jaw 50. It is preferable to integrally cast each stop as part of the sideframe, as shown in FIG. 8, although they can be first fabricated or cast as separate pieces, and then later attached to the sideframe by welding or any other suitable means. FIGS. 2 and 3 exemplify the fabricated version having inside faces 153,163 of each front and back stop 150,160, butted against sideframe inboard and outboard faces 13,14 and then welded to the appropriate sideframe face. Bolting is not recommended due to the extremely high magnitude of forces acting at the axles and pedestal jaws. Regardless of how they are attached to the sideframe, back stops 160 will be located such that a front surface 161 will be co-extensive with pedestal jaw rearward wall 29 of the respective pedestal jaw. When bearing adapter 70 and axle ends 15,17 are assembled into pedestal jaw opening 35, front face 161 of back stop 160 will nearly be in abutting contact with outside surface 121 of chock back leg 120. Front stop 150 on the otherhand, is provided with a substantial tolerance between rear face 152 and outside surface 116 of chock front leg 115 to receive wedge 170, as best seen from FIG. 3. Furthermore, FIG. 2 shows front stop rear face 152 as being acutely angled and complementary to the surface of wedge 170. Wedge 170 is one component of a simple means incorporated into the present invention for maintaining continuous rigid contact between the stops and the bearing adapter chocks. Without such a means, wear between the stops and the bearing adapter chocks would eventually lead to enough component slack to cause bearing adapter rotation and truck warpage.

FIGS. 2 and 3 also illustrate that at least one restraining finger 180 longitudinally projects from front stop 150, thereby forming a second component of the means for maintaining rigid contact. Cooperating with wedge 170, restraining finger 180 laterally restrains wedge 170 within wedge pocket 190, ensuring that continuous contact is made between the chock legs and the stops. Otherwise, if no restraining means was provided, the wedge would eventually work its lateral way out of wedge pocket 190 and out of contact with the stops and chocks. Wedge pocket 190 is best seen from viewing FIG. 3 and the inboard side of sideframe 12 where wedge 170 has been removed so that pocket 190 can be clearly seen and defined as the open area bounded by front stop 150, bearing adapter chock front leg 115, finger(s) 180, and the respective sideframe face, in this case, inboard face 13. Instead of using multiple restraining fingers, it is possible to cast front stop 150 with a projecting restraining flange instead (not shown). In any event, it is preferred that wedge 170 be formed with a generally triangular shape such that it includes a base 172, which in this case is shown to be horizontal, a vertical side 174, and an acutely tapered face 176. The physical width of wedge 170 is substantially equal to the width of wedge pocket 190. In this way, the tolerances between wedge 170, finger 180, and face 13 will be minimal. Small tolerances will allow easy assembly of the wedge into the pocket. Rear face 152 of front stop 150 should have an acutely angled face which is complementary to face 176 on wedge 170 so that only one wedge is required on each inboard and outboard side of each pedestal jaw opening. It is also important to construct rear face 152 with an angle of no more than 5° off vertical axis V, so that wedge 170 will easily descend downwardly by gravity as the system wears. It is desirable to keep the angle small because if the angle were too large, wedge 170 would have a tendency to easily pop out of its position between the stop and the chock when acted upon. It should also be appreciated that the means for maintaining rigid continuous contact is a quick and simple method for installing and removing the bearing adapter from the sideframe.

Two modified versions of the means for retaining rigid contact are shown in FIGS. 8A and 8B. FIG. 8 shows the pedestal jaw incorporating the bearing adapter of FIG. 8B, which requires inside faces 153,163 of front and back stops 150,160, to be cast as part of sideframe 12. Rear face 152 of the front stop is vertically planar, as is front face 161 of back stop 160. The bearing adapter of FIG. 8B illustrates that each inboard and outboard bearing adapter chock will have respective front legs 115 which will include acutely angled outside surfaces 116 interposed between upstanding inboard and outboard flanges 215,220. FIG. 8 best illustrates that when the bearing adapter of FIG. 8B is assembled inside pedestal jaw opening 35, front stop 150 and upstanding flanges 215,220 on front leg 115, collectively form wedge retaining pocket 190 that prevents wedge 170 from lateral movement and escape. It should also be dear that each of tapered surfaces 116 are complementary to tapered faces 176 on wedge 170, and that vertical wedge side 174 will be opposing planar rear face 152, and that wedge 170 will perform exactly as described above.

The FIG. 8A bearing adapter illustrates that front legs 115 on inboard and outboard chocks 100,110 have vertically planar outside surfaces 116, interposed between upstanding flanges 215,220. If the bearing adapter of FIG. 8A were inserted within the pedestal jaw area of FIG. 8, each of front stops 150 will be formed with an acutely angled rear face 152, which will cooperate with upstanding flanges 215,220 on the adapter, thereby forming wedge pocket 190 for retaining triangularly shaped wedge 170 therein. This pocket will be similar to the one shown in FIG. 8, except that the angled surface which interacts with tapered face 176 on the wedge, will now be located on the stop instead of the adapter. This makes the bearing adapter arrangement similar to the fabricated one shown in FIGS. 2 and 3. In that respect, the wedge vertical side 174 would be in confronting relationship with vertical outside surface 116 on front leg 115, while tapered wedge face 176 would be opposing an acutely angled rear face 152 on front stop 150. Like the previous embodiments, tapered wedge face 176 on the wedge would be complementary to angled rear face 152 on the front stop and would function with all the advantages as previously described for wedge 170.

Optionally, any of the above-described embodiments could also include means 250, usually a pin or bolt, for preventing the wedge from vertically lifting out of the wedge pocket once it is inserted therein, and it would be installed on the end of the wedge which is opposite to base 172. FIG. 8 illustrates that a pre-drilled and tapped hole is furnished for receiving a threaded bolt or pin. It is important not to extend the bolt through the entire wedge, or else it will interfere with descent of the wedge within the wedge pocket.

Turning attention now to FIGS. 9, 9A and 9B, the bearing adapter of the present invention which is prevented from laterally displacing will now be discussed. Essentially, this system is operationally and structurally equivalent to the longitudinally-prevented system, except that some of the key components have been arranged to operate laterally with respect to longitudinal axis L, instead of longitudinally. Only a general overview of the lateral system will be described in greater detail since the components of the longitudinal system are common to the lateral system, and this general correspondence means that like components will use the same reference characters. In addition, only a unitary bearing adapter will be described, although it should be understood that the chocks which are incorporated into the bearing adapter body can be fabricated.

In FIG. 9, it is seen that this bearing adapter also includes inboard and outboard chocks 100,110 which operationally prevent the bearing adapter from displacing within the pedestal jaw opening, but in the lateral direction. Like the previously described bearing adapters, the adapters of FIGS. 9, 9A and 9B cooperate with a means for preventing lateral bearing adapter displacement in the form of a set of front and back stops, 150,160, on each inboard 13 and outboard 14 sideframe face. Each stop simultaneously acts against each inboard and outboard chock 100,110 such that each bearing adapter 70, bearing assembly 25, and each axle end 15,17, cannot laterally displace. Collectively, inboard and outboard stops 150,160 at each sideframe pedestal jaw area will prevent all lateral truck axle movement within each pedestal jaw opening, even when out-of-squaring conditions are encountered by the truck. It is preferable to cast each inboard and outboard set of front and back stops as an integral part of the sideframe, although they can be fabricated or cast as separate pieces for later attachment to the sideframe by welding, or any other suitable means. Regardless of how they are attached to the sideframe, all front and back stops 150,160 will be located such that a respective surface on each stop will be co-extensive with a respective pedestal jaw forward or rearward wall 28,29 of the pedestal jaw. This differs from the bearing adapters that are prevented from longitudinal movement where only the back stops are coextensive with the rearward pedestal jaw wall. By co-extensive, it is meant that each of front stops 150 will have a respective rear face 152 in alignment with the same planar surface which defines pedestal jaw forward wall 28, while each of back stops 160 will have a respective front face 161 in alignment with the same planar surface which defines pedestal jaw rearward wall 29. FIG. 9 only shows the co-extensive condition with respect to back stop 160 and rearward wall 29. When bearing adapter 70 and axle ends 15,17 are assembled into the pedestal jaw opening, outboard side faces 154,164 of front and back stop 150,160 on the inboard side of sideframe 12, will nearly be in abutting contact with a respective front and back inward side surface 117,123 on front and back legs 115,120, on chock 100, although only the front stop is visible. Front and back stops 150,160 on the outboard side of sideframe 12 on the otherhand, are each provided with a substantial tolerance between a respective outboard side face 154,164, and a respective inward side surface 117,123 on front and back legs 115,120 on chock 110, and this tolerance defines wedge pocket 190 for receiving wedge 170. As before, wedge 170 serves as a means for providing continuous rigid contact between bearing adapter legs 115,120 and stops 150,160, and should be constructed such that it will easily descend by gravity as the system wears.

Turning attention to FIG. 9A, it is seen that inward side surfaces 117,123 on respective front leg 115 and back leg 120 on outboard chock 110 of each bearing adapter are acutely angled and complementary to tapered face 176 on wedge 170. In this way, when wedge 170 is inserted within wedge pocket 190, the entire bearing adapter is pulled in the lateral direction of the heavy-lined arrows through the action of the wedge. When this occurs, inward side surfaces 117,123, of front and back legs 115,120 on inboard chock 100 of the bearing adapter will be pulled into tightly-abutting contact with a respective front or back stop 150, 160, on the inboard side of sideframe 12. At that point, no lateral slack will remain in the system, and the bearing adapter will effectively be locked in place within the pedestal jaw opening. It is important to construct chock leg inward side surfaces 117,123 on outboard chock 110 with an angle of no more than 5° off vertical axis V, so that wedge 170 will easily descend downwardly by gravity as the system wears. If the angle is made too large, wedge 170 would have a tendency to easily pop out of its position between the stop and the chock when acted upon. It should also be appreciated that with the FIGS. 9A and 9B embodiments, the means for maintaining rigid continuous contact, wedge 170, will only be associated with outboard chock 110 on each bearing adapter so that a quick method of inspection and installation is possible from the track side of each sideframe. The bearing adapter shown in FIG. 9B differs from the one shown in FIG. 9A only with respect to surfaces 117,123 on outboard chock 110 of each bearing adapter wherein these surfaces are constructed so as to be vertically planar instead of angled. Although it is not shown in the figures, when the FIG. 9B adapter is inserted within the pedestal jaw opening, the front and back stop corresponding with outboard chock 110, will have tapered faces 154,164 that are complementary to tapered face 176 on wedge 170. This means that each wedge 170 will have a vertical side 174 in confronting relationship to planar inward surface 117 or 123 on adapter 70 and each wedge 170 will perform as described above.

Each of FIG. 9 bearing adapter embodiments further illustrate that front and back legs 115,120 on outboard chocks 110 will have a respective inward surface 117,123 interposed between upstanding flanges 215,220 on each leg. Each of front and back stops 150,160 on the outboard side of sideframe 12, along with upstanding flanges 215,220, and surfaces 117,123, will cooperate to form wedge pocket 190 for retaining triangularly shaped wedge 170 therein when the adapter is inserted in the pedestal jaw. When the FIG. 9A, adapter is used, surfaces 117,123 are angled and they interact with tapered and complementary face 176 on the wedge. When the FIG. 9B adapter is used, an angled surface which is complementary to the tapered wedge face will now be located on respective stops 150,160, instead of on the adapter chock legs. In addition, wedge vertical side 174 would be in confronting relationship with a planar vertical inward surface 117,123 on a respective front or back leg 115,120.

Like the previous embodiments, any of the above-described FIG. 9 embodiments could also include means 250 for preventing the wedge from vertically lifting out of the wedge pocket once it is inserted therein, and it would be installed on the end of the wedge which is opposite to base 172. FIG. 9 illustrates that a pre-drilled and tapped hole is furnished for receiving a threaded bolt or pin. It is important not to extend the bolt through the entire wedge, or else it will interfere with descent of the wedge within the wedge pocket.

As mentioned before, the primary desire of the present invention is to prevent the bearing adapter from rotationally displacing within the pedestal jaw opening, thus other means besides the wedge could be used for securing the bearing adapter against lateral movement. Although bolting or welding each of the chocks to the front and back stops can be used, both methods are unfavored over the wedge means, since that means is simple, easily removable, and least expensive. It should be further realized that once again, each of the means for securing the bearing adapter to the sideframe (chock and stops) also perform the incidental function of distributing the extreme forces acting on the bearing adapter into the sideframe during the time the axle is being prevented from displacing within the pedestal jaw. The large front and rear stops and chocks are provided to more uniformly distribute the forces over a greater surface area, thereby reducing the wear rate of the bearing adapter and the stops.

The foregoing description has been provided to dearly define and completely describe the present invention. Various modifications may be made without departing from the scope and spirit of the invention which is defined in the following claims.

What is claimed is:

1. An improved railway truck assembly having a first sideframe and a second sideframe, each of said sideframes having an inboard face, an outboard face, a first end with a first pedestal jaw, a second end with a second pedestal jaw, and a midsection therebetween, said first and second pedestal jaws each having inboard and outboard sides corresponding to said sideframe inboard and outboard faces, each of said sideframes laterally spaced from each other and disposed along a longitudinal axis, each of said first and second pedestal jaws formed by a vertically disposed forward wall, a vertically disposed rearward wall, and a horizontally disposed pedestal roof interconnecting said forward and rearward walls and thereby defining respective first and second pedestal jaw openings on each of said sideframes, each of said pedestal jaw openings having a lateral extent and a longitudinal extent, wherein said longitudinal extent generally corresponds to a defined span between said forward wall and said rearward wall and said lateral extent generally corresponds to a defined width between said sideframe inboard and outboard faces, a transversely disposed bolster extending between said sideframes at each of said sideframe midsections, a first axle and a second axle, said first and second axles longitudinally spaced from each other and traversing between said sideframes, said axles generally parallel to each other, said first and second axles each having inboard and outboard ends with a respective bearing assembly mounted thereon, each of said pedestal jaw openings accommodating one said bearing assembly and one said axle end, each of said bearing assemblies having a generally cylindrical body formed by an outer race centered about a horizontal and vertical axis of said assembly, thereby defining upper and lower bearing assembly quadrants, said vertical axis passing through a longitudinal midpoint of said bearing assembly and said horizontal axis passing through a vertical midpoint of said assembly, said cylindrical body forming a substantially circular bearing assembly cross section having a first diameter at said horizontal centerline, a plurality of wheel bearing adapters, each said pedestal jaw opening accommodating a bearing adapter, each said bearing adapter having a body with an arcuate bottom surface, a top surface, an inboard side and an outboard side, said top surface on each said bearing adapter body contacting said pedestal jaw roof, and said arcuate bottom surface on each said adapter body in communication with said bearing assembly outer race, the improvement comprising:

means for locking each of said bearing adapters within said respective pedestal jaw opening to prevent rotational bearing adapter displacement within said pedestal jaw opening and to simultaneously maintain each said axle end at a substantially right angular relationship with respect to each of said sideframes, thereby increasing truck warp stiffness.

2. The railway truck of claim 1 wherein said means for locking prevents rotational bearing adapter displacement by eliminating one of longitudinal or lateral bearing adapter movement within said pedestal jaw opening.

3. The railway truck of claim 2 wherein said means for locking each of said bearing adapters comprises an inboard and an outboard bearing adapter chock and means for simultaneously preventing displacement of each of said chocks, each of said inboard and outboard chocks projecting downwardly from a respective said bearing adapter inboard and outboard side, each of said inboard and outboard bearing adapter chocks having a front leg, a back leg, and a roof portion interconnecting with said legs, said roof portion and each of said legs having inside arcuate surfaces which cooperate with said arcuate bottom surface of said body to define a bearing assembly receiving cavity, which cavity is generally semicylindrical with a second diameter substantially coextensive with said horizontal centerline of said bearing assembly within said cavity, said inboard and outboard bearing adapter chocks at each of said pedestal jaw openings encapsulating said outer race of said bearing assembly accommodated within said pedestal jaw opening.

4. The railway truck of claim 3 wherein said first diameter of said bearing assembly outer race is approximately identical to said second diameter of said bearing receiving cavity for mating said bearing assembly within said receiving cavity, said front and back legs of each of said inboard and outboard chocks contacting said bearing assembly outer race at said horizontal centerline after said assembly is received within said cavity, said establishing an inboard and outboard set of contact points.

5. The railway truck of claim 4 wherein each of said inboard and outboard chock front and back legs protrudes beyond said horizontal centerline of said bearing assembly a substantially equal extent.

6. The railway truck of claim 5 wherein each of said front and back legs protrudes an extent beyond said horizontal centerline by about one sixteenth of said first diameter of said bearing assembly outer race.

7. The railway truck of claim 6 wherein said front leg, said back leg, and said roof portion of each said inboard and outboard bearing adapter chocks cooperate to define a generally U-shaped configuration on end, each of said front and back legs and said roof portion having an outside surface, said outside surface of each of said front and back legs being substantially vertical with respect to said pedestal jaw roof and in confronting relationship to said means for preventing displacement, said outside surface of said roof portion being substantially parallel to said pedestal jaw roof, each of said front and back legs having a vertical extent of substantially equal proportion.

8. The railway truck of claim 7 wherein each said inboard and outboard means for preventing displacement comprises a front stop and a back stop at each said pedestal jaw, each said front and back stop having a front face, a rear face, an inside face and an outside face, each said inside face on each said inboard and outboard stop secured to one of said sideframe inboard and outboard faces respectively, said from stops in proximity to a pedestal jaw forward wall and said back stops in proximity to a pedestal jaw rearward wall, said front stops indirectly contacting said bearing adapter in said pedestal jaw and said back stops directly contacting said bearing adapter.

9. The railway truck of claim 8 wherein said inboard and outboard chocks of each said bearing adapter at each said pedestal jaw are laterally displaced from each other by said width of said pedestal jaw opening.

10. The railway truck of claim 9 wherein each said means for preventing displacement includes an inboard means and an outboard means for maintaining continuous rigid contact between each of said bearing adapter chock front legs and back legs and each of said front and back stops, said inboard means and said outboard means for maintaining rigid contact interposed, respectively, between said each of said front stops and each of said inboard and outboard chocks.

11. The railway truck of claim 10 wherein each of said inboard and outboard means for maintaining rigid contact comprises a wedge and a wedge retainer, said wedge retainer comprised of at least one finger longitudinally projecting from said rear face of said front stop in order to prevent said wedge from laterally displacing, said wedge having a generally triangular shape formed by a base, a substantially vertical side connected to said base, and a tapered face, said tapered face projecting from said base to said vertical side.

12. The railway truck of claim 11 wherein said front face of each of said inboard and outboard back stops is coextensive with said pedestal jaw rearward wall and said rear face of each of said inboard and outboard front stops is longitudinally offset from said pedestal jaw forward wall, said offset forming a wedge pocket for receiving said wedge therein, said wedge pocket defined as an open area bounded by one of said sideframe inboard and outboard faces, said wedge retainer, said rear face of said front stop, and said outside surface of said front leg of said chock.

13. The railway truck of claim 12 wherein said rear face of each said inboard and outboard front stops is sloped at an acute angle, said sloped rear face being complementary with said tapered face of said wedge.

14. The railway truck of claim 10 wherein each of said inboard and outboard means for retaining rigid contact comprises a wedge and a wedge retainer, said wedge retainer comprised of vertically disposed inboard and outboard flanges projecting from said outside surface of each of said front legs of each of said inboard and outboard chocks, said wedge retainer preventing said wedge from laterally displacing, said wedge having a generally triangular shape formed by a base, a substantially vertical side connected to said base, and a tapered face, said tapered face projecting from said base to said vertical side.

15. The railway truck of claim 14 wherein said front face of each of said inboard and outboard back stops is coextensive with said pedestal jaw rearward wall and said rear face of each of said inboard and outboard front stops is longitudinally offset from said pedestal jaw forward wall, said offset forming a wedge pocket for receiving said wedge therein, said wedge pocket defined as an open area bounded by said rear face of said front stop, and said outside surface of said front leg of said chock and each of said vertically disposed inboard and outboard flanges.

16. The railway truck of claim 15 wherein said rear face of each of said inboard and outboard front stops is planar and said outside surface of each of said inboard and outboard front legs of each said chock is inclined between said vertically disposed flanges, said inclined surface being complementary with said tapered face of said wedge.

17. The railway truck of claim 16 wherein said rear face of each of said inboard and outboard front stops is acutely angled, and said outside surface on each of said front legs of said inboard and outboard chocks is planar between said vertically disposed flanges.

18. The bearing adapter as claimed in claim 16 wherein each of said inboard and outboard chocks are integrally formed with said body portion.

19. The bearing adapter as claimed in claim 17 wherein each of said inboard and outboard chocks are integrally formed with said body portion.

20. The railway truck of claim 9 wherein each of said means for preventing displacement further includes a front and back means for maintaining continuous rigid contact between each of said bearing adapter chocks and each of said front and back stops on said outboard side of said sideframe, said front means and said back means for maintaining rigid contact interposed, respectively, between said each of said front and back stops and each of said outboard chocks.

21. The railway truck of claim 20 wherein each of said inboard and outboard means for retaining rigid contact comprises a wedge and a wedge retainer, said wedge retainer comprised of vertically disposed forward and rearward flanges projecting from said inward side surface of each of said front and back legs of each of said outboard chocks, said wedge retainer preventing said wedge from longitudinally displacing, said wedge having a generally triangular shape formed by a base, a substantially vertical side connected to said base, and a tapered face, said tapered face projecting from said base to said vertical side.

22. The railway truck of claim 21 wherein said front face of each of said inboard and outboard back stops is coextensive with said pedestal jaw rearward wall and said rear face of each of said inboard and outboard front stops is coextensive with said pedestal jaw forward wall, said front and back stops on said outboard sideframe side and said outboard chock front and back legs forming a respective front wedge receiving pocket and a back wedge receiving pocket, each of said pockets for receiving a respective said wedge therein, each of said respective wedge pockets defined as an open area bounded by said outside face of said respective stop, said inward side surface of said respective outboard chock leg, and said vertically disposed front and back flanges on said respective chock leg.

23. The railway truck of claim 22 wherein said outside face of each of said front and back stops on said outboard side of said sideframe is planar and said inward side surface of each of said front and back legs on each of said outboard chocks is inclined between said vertically disposed flanges, said inclined surface being complementary to said tapered face of said wedge.

24. The railway truck of claim 23 wherein said outside face of each of said front and back stops on said outboard side of said sideframe is acutely angled, and said inward side surface on each of said front and back legs on each of said outboard chocks is vertically planar between said vertically disposed flanges.

25. The bearing adapter as claimed in claim 24 wherein each of said inboard and outboard chocks are integrally formed with said body portion.

26. A bearing adapter associated with a bearing assembly mounted on an axle end of an axle for a railway wheel, said bearing adapter received within a pedestal jaw opening of a railway truck sideframe, said sideframe having a longitudinal axis, an inboard face and an outboard face, each said pedestal jaw opening having a pedestal jaw roof, a forward wall and a rearward wall, said pedestal jaw forward and rearward walls generally normal to said longitudinal axis and extending downwardly from said roof, each of said pedestal jaw openings having a lateral extent and a longitudinal extent, said longitudinal extent generally corresponding to a defined span between said forward wall and said rearward walls, and said lateral extent generally corresponding to a defined width between said sideframe inboard and outboard faces, each of said pedestal jaw openings bounded by an inboard and an outboard front stop and an inboard and outboard back stop, each of said inboard and outboard front and back stops respectively located on said inboard and outboard sideframe faces, each of said front stops associated with a said pedestal jaw forward wall and each of said back stops associated with a said pedestal jaw rearward wall, wherein said inboard and outboard front and back stops at each of said pedestal jaws has a front face, a rear face, an inboard side face and an outboard side face, said inboard side faces on each of said stops connected to one of said sideframe inboard and outboard faces, said inboard and outboard front stops at a respective said pedestal jaw commonly associated with said pedestal jaw forward wall and said inboard and outboard back stops at a same respective said pedestal jaw commonly associated with said pedestal jaw rearward wall, said inboard and outboard front stops at each said respective pedestal jaw indirectly contacting said same bearing adapter accommodated therein and each of said inboard and outboard back stops at each respective said pedestal jaw directly contacting said same bearing adapter accommodated therein, said axles, said axle ends, and said bearing assemblies each having a generally cylindrical shape, each of said bearing assemblies having a generally cylindrical body formed by an outer race centered about a horizontal centerline, thereby defining an upper and a lower bearing assembly quadrant, said cylindrical body forming a circular bearing assembly cross section with a first diameter at said horizontal centerline, said cross section transverse to said longitudinal axis, said bearing adapter comprising:

means for locking each of said bearing adapters within said pedestal jaw opening to prevent each of said bearing adapters from at least one of longitudinal and lateral movement, and rotational movement within said pedestal jaw opening and to maintain said axle end at a substantially right angular relationship with respect to said sideframe.

27. The railway truck of claim 26 wherein said means for locking each of said bearing adapters comprises an inboard and an outboard bearing adapter chock and a means for simultaneously preventing displacement of each of said chocks, each of said inboard and outboard chocks projecting downwardly from a respective said bearing adapter inboard and outboard side, each of said inboard and outboard bearing adapter chocks having a front leg, a back leg, and a roof portion interconnecting with said legs, said roof portion and each of said legs having inside arcuate surfaces cooperating to define a bearing assembly receiving cavity, which said cavity is generally cylindrical and has a second diameter substantially coextensive with said horizontal centerline of said bearing assembly when said assembly is received within said cavity, said inboard and outboard bearing adapter chocks at each respective said pedestal jaw opening encapsulating said outer race of said bearing assembly accommodated within said pedestal jaw opening.

28. The railway truck of claim 27 wherein said first diameter of said bearing assembly outer race is approximately identical to said second diameter of said bearing receiving cavity for mating said bearing assembly within said receiving cavity, said front and back legs of each of said inboard and outboard chocks contacting said bearing assembly outer race at said horizontal centerline after said assembly is received within said cavity, said contact establishing a inboard and outboard set of contact points.

29. The railway truck of claim 28 wherein each of said inboard and outboard chock front and back legs protrudes beyond said horizontal centerline of said bearing assembly a substantially equal extent.

30. The railway truck of claim 29 wherein each of said front and back legs protrudes an extent beyond said horizontal centerline by about one sixteenth of said first diameter of said bearing assembly outer race.

31. The railway truck of claim 30 wherein each of said inboard and outboard bearing adapter chocks has a generally U-shaped configuration defined by the interconnection of said front leg, said back leg, and said roof portion, each of said front and back legs and said roof portion having an outside surface, said outside surface of each of said front and back legs being substantially vertical to said pedestal jaw roof and having a vertical extent of substantially equal proportion, each of said inboard and outboard front legs in confronting relationship to respective said inboard and outboard front stops, and each of said inboard and outboard back legs in confronting relationship to respective inboard and outboard back stops, said outside surface of said roof portion being substantially parallel to said pedestal jaw roof.

32. The bearing adapter of claim 31 wherein each of said inboard and outboard chocks at each respective said pedestal jaw are laterally displaced from each other by said width of said pedestal jaw opening.

33. The bearing adapter of claim 32 wherein each of said means for preventing displacement further includes an inboard and outboard means for maintaining continuous rigid contact between each of said bearing adapter chocks and each of said front and back stops, said inboard means and outboard means for maintaining rigid contact interposed, respectively, between said each of said front stops and each of said inboard and outboard chocks.

34. The railway truck of claim 33 wherein each of said inboard and outboard means for maintaining rigid contact comprises a wedge and a wedge retainer, said wedge retainer comprised of at least one finger longitudinally projecting from said rear face of said front stop in order to prevent said wedge from laterally displacing, said wedge having a generally triangular shape formed by a horizontal base, a substantially vertical side connected to said base, and a tapered face, said tapered face projecting from said base to said vertical side.

35. The railway truck of claim 34 wherein said front face of each of said inboard and outboard back stops is coextensive with said pedestal jaw rearward wall and said rear face of each of said inboard and outboard front stops is longitudinally offset from said pedestal jaw forward wall, said offset forming a wedge pocket for receiving said wedge therein, said wedge pocket defined as an open area bounded by one of said sideframe inboard and outboard faces, said front stop, said front leg of said chock, and said wedge retainer.

36. The railway truck of claim 35 wherein said rear face of each said inboard and outboard front stops is sloped at an acute angle, said sloped rear face being complementary with said tapered face of said wedge.

37. The railway truck of claim 33 wherein each of said inboard and outboard means for retaining rigid contact comprises a wedge and a wedge retainer, said wedge retainer comprised of vertically disposed inboard and outboard flanges projecting from said front leg outside surface of each of said inboard and outboard chocks, said wedge retainer preventing said wedge from laterally displacing, said wedge having a generally triangular shape formed by a horizontal base, a substantially vertical side connected to said base, and a tapered face, said tapered face projecting from said base to said vertical side.

38. The railway track of claim 37 wherein said front face of each of said inboard and outboard back stops is coextensive with said pedestal jaw rearward wall and said rear face of each of said inboard and outboard front stops is longitudinally offset from said pedestal jaw forward wall, said offset forming a wedge pocket for receiving said wedge therein, said wedge pocket defined as an open area bounded by said front stop and said vertically disposed inboard and outboard flanges projecting from said front leg of said chock.

39. The railway truck of claim 38 wherein said rear face of each of said inboard and outboard front stops is planar and said outside surface of each of said inboard and outboard front legs is inclined between said vertically disposed flanges, said inclined surface being complementary with said tapered face of said wedge.

40. The bearing adapter as claimed in claim 36 wherein each of said inboard and outboard chocks are integrally formed with said body portion.

41. The bearing adapter as claimed in claim 39 wherein each of said inboard and outboard chocks are integrally formed with said body portion.

42. A plurality of bearing adapters, a bearing adapter associated with each bearing assembly mounted on an axle end of an axle for a railway wheel, each said bearing adapter associated with an axle end received within one of a first pedestal jaw and a second pedestal jaw opening of a railway truck sideframe, said sideframe having a longitudinal axis, an inboard face and an outboard face, each of said pedestal jaw openings formed by a pedestal jaw roof, a forward wall and a rearward wall, said pedestal jaw forward and rearward walls generally normal to said longitudinal axis and extending downwardly from said roof, each of said pedestal jaw openings having a lateral extent and a longitudinal extent, said longitudinal extent generally corresponding to a span defined between each said forward wall and said rearward wall, and said lateral extent generally corresponding to a defined width between said sideframe inboard and outboard faces, each of said pedestal jaw openings bounded by an inboard and an outboard front stop and an inboard and outboard back stop, each of said inboard and outboard front and back stops respectively located on said inboard and outboard sideframe faces, each of said front stops associated with said pedestal jaw forward wall and each of said back stops associated with said pedestal jaw rearward wall, wherein said inboard and outboard front and back stops at each of said pedestal jaws has a front face, a rear face, an inside face and an outside face, said inside faces on each of said stops connected to one of said sideframe inboard and outboard faces, said inboard and outboard front stops at each respective said pedestal jaw commonly associated with said pedestal jaw forward wall and said inboard and outboard back stops at a same respective said pedestal jaw commonly associated with said pedestal jaw rearward wall, said front and back stops on said outboard face of said sideframe indirectly contacting said bearing adapter and each of said front and back stops on said inboard face of said sideframe directly contacting said same bearing adapter, each of said axles, said axle ends, and said bearing assemblies having a generally cylindrical shape, each of said bearing assemblies having a generally cylindrical body formed by an outer race centered about a horizontal centerline, thereby defining an upper and a lower bearing assembly quadrant, said cylindrical body forming a circular bearing assembly cross section with a first diameter at said horizontal centerline, said cross section transverse to said longitudinal axis, said improvement comprising:

means for locking each of said bearing adapters within said respective pedestal jaw opening to prevent said bearing adapter from at least one of longitudinal and lateral movement, and to inhibit rotational movement between said bearing adapter and said bearing assembly within said pedestal jaw opening and to maintain said axle end at a substantially right angular relationship with respect to said sideframe.

43. The railway truck of claim 42 wherein said means for locking each of said bearing adapters comprises an inboard and an outboard bearing adapter chock and means for simultaneously preventing displacement of each of said chocks, each of said inboard and outboard chocks having an inboard side and an outboard side, said inboard and outboard chocks projecting downwardly from a respective bearing adapter inboard and outboard side, each of said inboard and outboard bearing adapter chocks having a front leg, a back leg, and a roof potion interconnecting said legs, said roof portion and each of said legs having inside arcuate surfaces cooperating to define a bearing assembly receiving cavity, which said cavity is generally cylindrical and has a second diameter substantially coextensive with said horizontal centerline of said bearing assembly when said assembly is received within said cavity, said inboard and outboard bearing adapter chocks at each said pedestal jaw opening encapsulating said outer race of said bearing assembly accommodated within said pedestal jaw opening.

44. The railway truck of claim 43 wherein said first diameter of said bearing assembly outer race is approximately identical to said second diameter of said bearing receiving cavity for mating said bearing assembly within said receiving cavity, said front and back legs of each of said inboard and outboard chocks contacting said bearing assembly outer race at said horizontal centerline after said assembly is received within said cavity, said contact establishing an inboard and outboard set of contact points.

45. The railway truck of claim 44 wherein each of said inboard and outboard chock front and back legs protrudes beyond said horizontal centerline of said bearing assembly a substantially equal extent.

46. The railway truck of claim 45 wherein each of said front and back legs protrudes an extent beyond said horizontal centerline by about one sixteenth of said first diameter of said bearing assembly outer race.

47. The railway truck of claim 46 wherein each of said inboard and outboard bearing adapter chocks has a generally U-shaped configuration defined by the interconnection of said front leg, said back leg, and said roof portion, each of said front and back legs and said roof portion having an outside surface, said outside surface of each of said front and back legs being substantially vertical to said pedestal jaw roof and having a vertical extent of substantially equal proportion, each of said inboard and outboard front legs in confronting relationship to said respective inboard and outboard front stops, and each of said inboard and outboard back legs in confronting relationship to said respective inboard and outboard back stops, said outside surface of said roof portion being substantially parallel to said pedestal jaw roof.

48. The bearing adapter of claim 47 wherein each of said inboard and outboard chocks at each respective said pedestal jaw are laterally displaced from each other by said width of said pedestal jaw opening.

49. The bearing adapter of claim 48 wherein each of said means for preventing displacement further includes an inboard and outboard means for maintaining continuous rigid contact between each of said bearing adapter chocks and each of said front and back stops, said means interposed between said each of said front stops and each of said inboard and outboard chocks.

50. The railway truck of claim 49 wherein each said inboard and outboard means for maintaining rigid contact comprises a wedge and a wedge retainer, said wedge retainer comprised of at least one finger longitudinally projecting from said rear face of said front stop to prevent said wedge from lateral displacement, said wedge having a generally triangular shape formed by a horizontal base, a substantially vertical side connected to said base, and a tapered face, said tapered face projecting from said base to said vertical side.

51. The railway truck of claim 50 wherein said front face of each of said inboard and outboard back stops is coextensive with said pedestal jaw rearward wall and said rear face of each of said inboard and outboard front stops is longitudinally offset from said pedestal jaw forward wall, said offset forming a wedge pocket for receiving said wedge therein, said wedge pocket defined as an open area bounded by one of said sideframe inboard and outboard faces, said front stop, said front leg of said chock, and said wedge retainer.

52. The railway truck of claim 51 wherein said rear face of each said inboard and outboard front stops is sloped at an acute angle, said sloped rear face being complementary with said tapered face of said wedge.

53. The railway truck of claim 49 wherein each of said inboard and outboard means for retaining rigid contact comprises a wedge and a wedge retainer, said wedge retainer comprised of vertically disposed inboard and outboard flanges projecting from said front leg outside surface of each of said inboard and outboard chocks, said wedge retainer preventing said wedge from laterally displacing, said wedge having a generally triangular shape formed by a horizontal base, a substantially vertical side connected to said base, and a tapered face, said tapered face projecting from said base to said vertical side.

54. The railway truck of claim 53 wherein said front face of each of said inboard and outboard back stops is coextensive with said pedestal jaw rearward wall and said rear face of each of said inboard and outboard front stops is longitudinally offset from said pedestal jaw forward wall, said offset forming a wedge pocket for receiving said wedge therein, said wedge pocket defined as an open area bounded by said front stop and said vertically disposed inboard and outboard flanges projecting from said front leg of said chock.

55. The railway truck of claim 54 wherein said rear face of each of said inboard and outboard front stops is planar and said outside surface of each of said inboard and outboard front legs is inclined between said vertically disposed flanges, said inclined surface being complementary with said tapered face of said wedge.

56. The bearing adapter as claimed in claim 52 wherein each of said inboard and outboard chocks are integrally formed with said body portion.

57. The bearing adapter as claimed in claim 53 wherein each of said inboard and outboard chocks are integrally formed with said body portion.

* * * * *